US006878512B2

(12) United States Patent
Fava et al.

(10) Patent No.: US 6,878,512 B2
(45) Date of Patent: Apr. 12, 2005

(54) SILVER HALIDE TABULAR GRAIN EMULSION

(75) Inventors: Simona Fava, Genoa (IT); Roberta Bellunghi, Carcare (IT); Roberta Ganduglia, Vado Ligure (IT); Luca Ceruti, Savona (IT)

(73) Assignee: Ferrania, S.p.A., Ferrania (IT)

( * ) Notice: Subject to any disclaimer, the term of this patent is extended or adjusted under 35 U.S.C. 154(b) by 0 days.

(21) Appl. No.: 10/697,513

(22) Filed: Oct. 30, 2003

(65) Prior Publication Data

US 2004/0086813 A1 May 6, 2004

(30) Foreign Application Priority Data

Oct. 31, 2002 (IT) ..... SV2002A0053

(51) Int. Cl.[7] ..... G03C 1/005; G03C 1/494
(52) U.S. Cl. ..... 430/567; 430/502
(58) Field of Search ..... 430/567, 502

(56) References Cited

U.S. PATENT DOCUMENTS

| | | | | |
|---|---|---|---|---|
| 4,301,241 | A | 11/1981 | Saito | 430/569 |
| 4,722,886 | A | 2/1988 | Nottorf | 430/569 |
| 4,797,354 | A | 1/1989 | Saitou et al. | 430/567 |
| 4,798,775 | A | 1/1989 | Yagi et al. | 430/569 |
| 4,801,522 | A | 1/1989 | Ellis | 430/569 |
| 5,013,641 | A | 5/1991 | Buntaine et al. | 430/569 |
| 5,028,521 | A | 7/1991 | Grzeskowiak | 430/569 |
| 5,254,453 | A | 10/1993 | Chang | 430/569 |
| 5,275,929 | A | 1/1994 | Buitano et al. | 430/567 |
| 5,302,499 | A | 4/1994 | Merrill et al. | 430/503 |
| 5,906,914 | A | 5/1999 | Taguchi et al. | 430/567 |
| 6,280,920 | B1 | 8/2001 | Tadanobu et al. | 430/567 |
| 6,395,464 | B1 * | 5/2002 | Suzuki et al. | 430/567 |
| 6,696,235 | B2 * | 2/2004 | Miki | 430/567 |
| 2002/0081541 | A1 | 6/2002 | Kikuchi | 430/567 |

FOREIGN PATENT DOCUMENTS

| | | |
|---|---|---|
| EP | 0 588 338 A2 | 3/1994 |
| EP | 0577886 B1 | 12/1996 |
| EP | 0515106 B1 | 3/1998 |
| EP | 0569075 B1 | 3/1998 |
| JP | 07191425 | 7/1995 |

* cited by examiner

*Primary Examiner*—Geraldine Letscher
(74) *Attorney, Agent, or Firm*—Mark A. Litman & Associates, P.A.

(57) ABSTRACT

The present invention relates to a new silver halide tabular grain emulsion, wherein said silver halide emulsion comprises tabular grains having average thickness lower than 0.15 $\mu$m, an average diameter of at least 1.20 $\mu$m and an average aspect ratio of at least 8:1, and showing a coefficient of diameter variation COVd within the range of from 31% to 44% and a coefficient of thickness variation COVt lower than 25%.

10 Claims, No Drawings

SILVER HALIDE TABULAR GRAIN EMULSION

BACKGROUND OF THE INVENTION

1. Field of the Invention

The present invention relates to a silver halide tabular grain emulsion useful in light-sensitive photographic materials. More in particular, the present invention relates to a silver halide tabular grain emulsion having a specific grain morphology to be used in radiographic materials.

2. Background of the Invention

Silver halide tabular grains, their preparation and use in photographic emulsions, are widely known. Silver halide tabular grains are crystals possessing two major faces that are substantially parallel. They have been extensively studied in the literature since photographic emulsions containing these grains appeared to offer some significant advantages over photographic emulsions containing round or globular or cubic grains. Tabular grains usually have polygonal (i.e., triangular or hexagonal) parallel crystal faces, each major face of which is usually greater than any other crystal face of the grain. These tabular grains are conventionally defined by their aspect ratio (namely AR) which is the ratio of the diameter of the grain to the thickness. Tabular grains offer significant technical and commercial advantages apparent to those skilled in the art. The most important advantages of tabular grains can be summarized as follows:

1. Tabular grains have a high surface to volume ratio so that a large amount of sensitizing dye can be adsorbed on the surface, and a high development rate and covering power can be obtained.
2. Tabular grains tend to lie parallel to the surface of the support base when emulsions containing them are coated and dried so that it is possible to reduce the thickness of the coated layer and accordingly to increase sharpness.
3. When a sensitizing dye is added to tabular grains, the extinction coefficient of the dye is greater than the extinction coefficient for the indirect transition of the silver halide so that in X-ray materials it is possible to obtain a relevant reduction in cross-over, thereby preventing any worsening of quality.
4. Tabular grains are usually very thin and so the amount of radiation absorbed per grain (proportional to the thickness) is low and there is low fogging resulting from natural radiation on aging.
5. Tabular grains show low light scattering and the images obtained from them have a high resolution.

In spite of all these advantages, tabular grain emulsions tend toward more dispersed grain populations than can be achieved in the preparation of silver halide conventional grains, e.g., cubic or octahedral grains. This has been a concern since reducing grain dispersion within an emulsion is generally recognized to increase the imaging consistency of the emulsion. Grain dispersion concern relates to (1) the presence of non-conforming grain shapes, such as, for example, octahedral, cubic, or rod shapes, (2) the variance of the grain size distribution, and (3) the variance of the grain thickness distribution.

Non-conforming grains can interact differently with light and exhibit some undesirable properties. For example, faces of non-tabular grains are randomly oriented with respect to the support base, octahedral grains exhibit lower covering power and greater thickness, and rod grains can self develop in the absence of light, thereby increasing fog.

On the other hand, even a population of grains having a common shape can have a high variability or high dispersion in terms of grain size and thickness distribution. A common method for quantifying grain size distribution is to extract a sample of individual grains, calculate the corresponding diameter for each grain ($D_{1\to n}$, wherein n is the number of extracted grains), calculate the average diameter ($Dm=\Sigma_{1\to n}D/n$), calculate the standard deviation of the grain population diameters (Sd), divide the standard deviation (Sd) by the average diameter (Dm) and multiply by 100, thereby obtaining the coefficient of diameter variation (COVd) of the grain population as a percentage. A similar method is used for quantifying the grain thickness distribution and obtaining the coefficient of thickness variation (COVt).

Accordingly, several solutions have been proposed in the art to reduce the COVd of tabular grain emulsions. Monodispersed tabular grain emulsions and methods to prepare them are disclosed in several patents and patent applications attempting to obtain tabular grains having reduced COVd by controlling various parameters during nucleation and ripening of the silver halide emulsion. The most important nucleation conditions to be kept under control for obtaining monodispersed tabular grain emulsions are temperature, gelatin concentration, addition rates of silver salt solution, addition rates of alkali halide solution, stirring rate, iodide content in the alkali halide solution, amount of silver halide solvent, pH of the dispersing medium, concentration of bromide ions in the reaction vessel, molecular weight of dispersing medium, iodide content in the vessel at the start, and the like. Similarly, the most important ripening conditions are temperature, dispersing medium concentration, silver halide solvent concentration, pBr, and addition rates of silver salt solution.

Saito in U.S. Pat. No. 4,301,241 describes a process for forming a silver halide emulsion containing multiple twin crystal grains and a narrow grain size distribution. The examples report multiple twin crystal grain silver bromoiodide emulsions having an average grain size from 0.86 to 1.023 $\mu$m and a COVd of from 11.6% to 13.6%.

Saitou et al. in U.S. Pat. No. 4,797,354 disclose a silver halide emulsion comprising hexagonal tabular grains with an "adjacent edge ratio" of from 2/1 to 1/1 accounting for 70% to 100% of the projected area of all the grains, and further that said hexagonal tabular grains are monodisperse and have an average aspect ratio from 2.5:1 to 20:1. The term "adjacent edge ratio" is referred to as the ratio of the longest edge length to the shortest edge length of each hexagonal tabular grain. Accordingly, the definition of "adjacent edge ratio" is a measure of the hexagon regularity.

U.S. Pat. No. 4,722,886 describes a process to form a monodispersed silver halide tabular grain emulsion comprising the steps of adding silver nitrate to a reaction vessel with a reaction solution comprising a bromide ion concentration of from 0.08 to 0.25 N to form silver halide nuclei, adding a basic silver halide solvent (e.g., ammonia solution) to achieve 0.02 to 0.2N of such a silver halide solvent after at least 2% by weight of the total silver has been added to the vessel, stopping silver nitrate addition for a time period of from 0.5 to 60 minutes at a bromide ion concentration of from 0.005 to 0.05 N, neutralizing at least part of the present solvent, and growing the formed silver halide grains by adding silver and halide (Br or Brl) soluble salts by balanced double jet.

U.S. Pat. No. 4,798,775 discloses a process to obtain monodispersed tabular grains comprising the steps of forming silver halide nuclei with a silver iodide content of from 0 to 5% in the mother liquor, by maintaining the pBr in the reaction vessel between 2.0 and −0.7 for at least the initial half of the nucleation time, ripening the nuclei formed in the nucleation step by maintaining the concentration of silver halide solvent from $10^{-4}$ to 5 moles per liter of mother liquor, and growing the seed grains by addition of silver and halide soluble salts or by addition of silver halide fine grains.

U.S. Pat. No. 4,801,522 discloses a process to form silver halide tabular grains having a thickness of from 0.05 to 0.5 μm, average grain volume of from 0.05 to 1.0 $mm^3$ and a mean aspect ratio higher than 2:1 comprising the steps of adding silver nitrate to a reaction vessel comprising a bromide ion concentration of from 0.08 to 0.25 N (pBr=1, 1-0,6), adding ammonia solution to achieve 0.002 to 0.2N after at least 2% of the total silver has been added to the vessel, and adding silver and halide (Br or Brl) salts by balanced double jet.

U.S. Pat. No. 5,013,641 describes a process of forming monodispersed silver halide emulsions comprising (a) combining silver nitrate and sodium bromide in gelatin solution, (b) adding NaOH to adjust the pH to greater than 9, (c) allowing digestion of the nucleated particles, (d) adjusting the pH to below 7 by acid addition, and (e) adding silver nitrate and sodium halide to grow the nucleated particles.

U.S. Pat. No. 5,254,453 discloses a process for forming monodispersed silver bromide or bromoiodide grains with COVd lower than 25%, thickness of from 0.05 to 0.5 μm, mean aspect ratio higher than 2, and diameter of from 0.2 to 3 μm comprising the following steps: (a) digesting the nucleated particles in a basic silver halide solvent at a concentration of from 0.0015 to 0.015 N and (b) neutralizing said basic solvent after digestion and before growing.

EP 569,075 discloses a process of forming monodispersed silver bromide or bromoiodide tabular emulsions with average aspect ratio higher than 2, an average thickness of from 0.15 and 0.30 μm, and a COVd of from 0.15 to 0.45 wherein the process is characterized by (a) providing a gelatin/bromide solution at a pBr of from 1.0 to 2.0, (b) nucleating by consuming less than 10% of the total silver nitrate used, (c) making a first double jet growth (consuming at least 10% of the total silver nitrate used) at a pBr value of from 1.0 and 2.5, and (d) making a second double jet growth (consuming at least 40% of the total silver nitrate used) at a pBr value higher than 2.7.

EP 577,886 describes a process of forming monodispersed silver bromide or bromoiodide tabular emulsions with average aspect ratio of from 2 to 8, and a COVd lower than 30. The process comprises the following steps: (a) performing a nucleation step by balanced double jet by precipitating at most 5% of the total silver halide, (b) ripening the formed nuclei, (c) performing at least one growing step by balanced double jet at pBr lower than 2, (d) ultrafiltrating the reaction mixture during the precipitation steps with an ultrafiltration flux equal to or greater than the sum of the flow rates of the silver and halide ion solutions.

Grzeskowiak, in U.S. Pat. No. 5,028,521, discloses a process for preparing monodispersed silver halide tabular grain emulsions having an aspect ratio from 3:1 to 12:1 consisting in (a) preparing a bromide/gelatin mixture at pBr of from 0.7 to 1.0, (b) adding silver nitrate and further halide to maintain excess of bromide, (c) adding ammonia to achieve at least 0.05N after at least 20% by weight of the total silver is added, (d) adding further silver nitrate and halide by balanced double jet, by maintaining an ammonia concentration of at least 0.03N.

EP 588,338 describes a process characterized by specific nucleating conditions, that comprise (a) adding from 0.30 to 9.0% by weight of the total amount of soluble silver salt to a vessel containing 0.08 to 0.25 M aqueous soluble halide salt (b) adding a solution of ammoniacal base when 0.30 to 9% by weight of the total amount of soluble silver salt has been added, (c) adding soluble silver salt to growth the pBr from 1.3 to 2.3, and (d) adding soluble silver and halide salts to grow tabular grains.

A few solutions have been proposed in the art to reduce or control the COVt of tabular grain emulsions. The thickness of grains can be controlled by optimally selecting parameters affecting supersaturation at the time of nucleation, such as gelatin concentration, gelatin type, temperature, iodide concentration, pBr, pH, ion-supplying rate and stirring rate. Highly supersaturated conditions during nucleation generally favor the reduction of thickness.

EP 515,106 discloses a silver halide emulsion comprised of silver halide hexagonal tabular grains having even-numbered twin planes parallel to the major face and a maximum adjacent edge ratio of 2.0 to 1.0, a COVd within a range of from 21% to 29% and a COVt of 20% or less.

U.S. Pat. Nos. 5,275,929 and 5,302,499 disclose silver halide tabular grain emulsions of aspect ratio greater than 10 sensitized in the red region wherein the thickness of the silver halide grains is about 0.14 to 0.17 μm to minimize the spectral reflectance in the region of the spectrum where the emulsion has its maximum sensitivity. The specification is silent about coefficients of variation of diameter and/or thickness.

U.S. Pat. No. 5,906,914 and JP-A-7-191425 disclose tabular grain emulsions having a COVd lower than 20% and a limitation with respect to a ratio of a variation coefficient of twin plane spacing to a variation coefficient of grain thickness.

SUMMARY OF THE INVENTION

The present invention relates to a new silver halide tabular grain emulsion, wherein the silver halide emulsion comprises tabular grains having an average thickness lower than 0.15 μm, an average diameter of at least 1.20 μm and an average aspect ratio of at least 8:1, and showing a coefficient of diameter variation COVd within the range of from 31% to 44% and a coefficient of thickness variation COVt lower than 25%.

DETAILED DESCRIPTION OF THE INVENTION

The present invention relates to a new silver halide tabular grain emulsion, wherein the silver halide emulsion comprises tabular grains having average thickness lower than 0.15 μm, an average diameter of at least 1.20 μm and an average aspect ratio of at least 8:1, and showing a coefficient of diameter variation COVd within the range of from 31% to 44% and a coefficient of thickness variation COVt lower than 25%.

Grain Preparation

Silver halide tabular grains contained in the silver halide emulsion of the present invention have an average diameter:thickness ratio (often referred to in the art as aspect ratio) of at least 8:1, preferably 8:1 to 50:1, more preferably 8:1 to 30:1, and most preferably 8:1 to 20:1. Average diameters of the silver halide tabular grains suitable for use in this invention preferably range from 1.20 to 5.00 μm, more preferably from 1.40 to 3.00 μm, and most preferably from 1.50 to 2.00 μm. The silver halide tabular grains suitable for use in this invention have a thickness of less than 0.15 μm, more preferably within the range of 0.05 to 0.15 μm.

The silver halide tabular grain dimensions and characteristics described above can be readily ascertained by procedures well-known to those skilled in the art. The term "diameter" means the diameter of a circle having an area equal to the projected area of the grain. The term "thickness" means the distance between two substantially parallel main planes constituting the silver halide tabular grains. From the measure of diameter and thickness of each grain, the diameter:thickness ratio of each grain can be calculated, and the diameter:thickness ratios of all tabular grains can be averaged to obtain their average diameter:thickness ratio. In practice, it is simpler to obtain the average diameter and the average thickness of the tabular grains and to calculate the average diameter:thickness ratio as the ratio of these two averages. Whatever the method used, the obtained values of average diameter:thickness ratio do not greatly differ.

The projected area of silver halide tabular grains in the emulsion of the present invention accounts for at least 50%, preferably at least 80% and more preferably at least 90% of the projected area of all the silver halide grains of the emulsion.

The coefficient of diameter variation COVd of the tabular grains of the emulsion of the present invention is within the range of from 31% to 44%, preferably from 34% to 41%. The coefficient of thickness variation COVt of the tabular grains of the emulsion of the present invention is lower than 25%, and more preferably lower than 20%.

It is widely known in the art that the COVd should be as small as possible. However, after extensive investigation, the inventors have found that the emulsion of the invention gave the best overall results when the COVd was maintained within the range of from 31% to 44%. This result is probably due to the specific morphology of the silver halide tabular grains, in particular because the emulsion of the invention comprise tabular grains having a very low thickness, a high aspect ratio and low iodine content. For the reason mentioned above, the optimum COVd value is to be within the range of 31% to 44%, and preferably of 34% to 41%. When the COVd is higher than 44%, the chemical sensitization aptitude becomes unsatisfactory, the pressure characteristics are deteriorated, and the toe contrast is too low, resulting in a poor image quality of the radiographic images. When the COVd is less than 31%, the toe contrast is too high, resulting in a poor image quality of the radiographic images in the high density zones.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for silver halide tabular grains, with silver bromoiodide compositions containing less than 10 mol % silver iodide, preferably less than 5 mol % silver iodide, and more preferably less than 1.5 mol % silver iodide. The halogen composition of individual grains may be homogeneous or heterogeneous.

The preparation process of a silver halide emulsion generally comprises a nucleation step, in which silver halide grain seeds are formed, followed by one or more growing steps, in which the grain seeds achieve their final dimension, and a washing step, in which all soluble salts are removed from the final emulsion. A ripening step is usually present between the nucleation and growing step and/or between the growing and the washing steps.

In the preparation of the silver halide emulsion of the present invention, an aqueous solution of a dispersing medium is put in a reaction vessel together with a bromide salt aqueous solution. The dispersing medium initially present in the reaction vessel can be chosen among those conventionally employed in the silver halide emulsions. The initial amount of dispersing medium is preferably in the range of from 10 to 50%, more preferably from 20 to 40% by weight relative to the total dispersing medium added during the overall emulsion making process, that is, from step (a) to (d). Preferred dispersion media include hydrophilic colloids, such as proteins, protein derivatives, cellulose derivatives (e.g. cellulose esters), gelatin (e.g. acid or alkali treated gelatin), gelatin derivatives (e.g. acetylated gelatin, phthalated gelatin and the like), polysaccharides (e.g. dextran) gum arabic, casein and the like. It is also common to employ said hydrophilic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like. The bromide salt is typically a water soluble salt of alkaline or alkaline earth metals, such as, for example, sodium bromide, potassium bromide, ammonium bromide, calcium bromide, or magnesium bromide.

The temperature of the reaction vessel content is preferably in the range of from 30° C. to 80° C., more preferably from 40° C. to 70° C. The pH of the starting solution ranges from 2 to 7, preferably from 3 to 6. The pBr of the starting solution ranges from 0 to 2, preferably from 0.5 to 1.5.

During the nucleation step (a), a soluble silver salt aqueous solution (usually a silver nitrate solution) and a soluble bromide salt aqueous solution (usually a sodium or potassium bromide solution) are added by double jet method to the reaction vessel at a constant flow rate ranging from 10 to 40 ml/min, preferably from 15 to 30 ml/min, by maintaining the temperature constant. During the nucleation step, the amount of silver nitrate added is lower than 5% by weight of total silver nitrate. According to the present invention, the term "total silver nitrate" means the amount of silver nitrate employed during the overall emulsion making process, that is, from step (a) to (d). After at least 30% by weight of silver nitrate to be used during nucleation has been added, the addition of bromide solution is stopped, a proper amount of gelatine is added to the dispersing medium (preferably from 90 to 50%, more preferably from 80 to 60% by weight relative to the total dispersing medium), and the nucleation step is terminated by single jet addition of silver nitrate solution, by increasing the temperature and the pBr.

At the end of the nucleation step, the addition of silver nitrate solution is stopped and the obtained silver halide grain seeds are subjected to the ripening step (b). The silver halide seeds are allowed to ripen at a temperature of from 30° to 80° C., preferably from 50° to 80° C., for a period of time ranging from 1 to 20 minutes, preferably from 5 to 15 minutes, in the presence of a silver halide solvent. The silver halide solvent is chosen amongst any conventionally known silver halide solvents, e.g., thiourea, ammonia, thioether, thiosulfate or thiocyanate. The concentration of the silver halide solvent into the reaction vessel after the addition can range from 0.002 to 0.3N, preferably form 0.02 to 0.2N. According to a preferred embodiment, the silver halide solvent is an ammonia aqueous solution. At the end of the ripening step, the pH of the reaction vessel content is adjusted to a value of from 4.5 to 6.5, preferably of about 6.

After that, the silver halide grain seeds are subjected to a growth step (c) by double jet addition of a silver nitrate aqueous solution and a halide salt aqueous solution at accelerated flow rate, with a linear ramp-starting from within 10 to 50 ml/min and rising to within 40 to 120 ml/min. The halide salt aqueous solution added during this step can either comprise bromide ions or a mixture of bromide and iodide ions. The pBr of the reaction vessel content is kept under control at a value of from 1.0 to 2.0, preferably from 1.0 to 1.5. During this growth step (c), the amount of silver nitrate added is from 55 to 90% by weight of total silver nitrate.

The final step (d) is performed by a double jet addition of a silver nitrate aqueous solution and a halide salt aqueous solution at a constant flow rate of from 20 to 70 ml/min. The halide salt aqueous solution added during this step can either comprise bromide ions or a mixture of bromide and iodide ions. During this step, the amount of silver nitrate added is from 10 to 40%, preferably from 25 to 35% by weight of total silver nitrate. During this step, the pBr is kept under control at a value of from 1.0 to 2.0, preferably from 1.0 to 1.5.

If during the growing step and/or the final step, a soluble iodide salt is added together with the bromide salt, the amount of the iodide present in the final emulsion ranges from 0.01 to 10% mol basis, preferably from 0.05 to 5% mol basis based on the total halide content.

At the end of the final step (d), the tabular grains can optionally be further ripened for a period of time of from 1 to 20 minutes.

At the end of silver halide grain precipitation, water soluble salts are removed from the emulsion by procedures known in the art. Suitable cleaning arrangements are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

In a particularly preferred embodiment, among the known techniques for removing the dispersing medium and soluble salts while retaining silver halide grains in the remaining dispersion, ultrafiltration is particularly advantageous. Typically, an ultrafiltration unit comprising membranes of inert, non-ionic polymers is used as a cleaning arrangement. Since silver halide grains are large in comparison with the dispersing medium and the soluble salts or ions, silver halide grains are retained by said membranes while the dispersing medium and the soluble salts dissolved therein are removed. The action mechanism of preferred membranes is described in GB 1,307,331. The membranes used in the ultrafiltration comprise a very thin layer of extremely fine pore texture supported upon a thicker porous structure. Suitable membranes consist of polymers such as polyvinylacetate, polyvinylalcohol, polyvinylformate, polyvinylethers, polyamides, polyimides, polyvinyl chloride and polyvinylidene chloride, aromatic polymers, such as aromatic polyesters, polytetrafluoroethylene, regenerated cellulose, cellulose esters, such as cellulose acetate, or mixed cellulose esters. The membranes in question have anisotropic, semipermeable properties, show considerable mechanical, thermal and chemical stability and are photographically inert. The membranes are preferably permeable to molecules having molecular weights of up to about 300,000 and, more especially, of up to about 50,000.

Chemical Sensitization

Prior to use, the silver halide tabular grain emulsion according to the present invention is generally fully dispersed and bulked up with gelatin or other dispersion of peptizer and subjected to any of the known methods for achieving optimum sensitivity.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. The silver halide tabular grains, after grain formation and desalting, are chemically sensitized by at least one gold sensitizer and at least one sulfur sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature, preferably 40° C. or more, for a predetermined period of time. As a gold sensitizer, any gold compound which has an oxidation number of +1 or +3 and is normally used as gold sensitizer can be used. Preferred examples of gold sensitizers are chloroauric acid, the salts thereof. and gold complexes, such as those described in U.S. Pat. No. 2,399,083. It is also useful to increase the gold sensitization by using a thiocyanate together with the gold sensitizer, as described, for example, in T. H. James, The Theory of the Photographic Process, 4th edition, page 155, published by MacMillan Co., 1977. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

Sulfur sensitization is performed by adding a sulfur sensitizer, for example a thiosulfonate, to the silver halide tabular grain emulsion and stirring the emulsion at a temperature of 40° C. or more for a predetermined period of time.

The amounts of the gold sensitizer and the sulfur sensitizer change in accordance with the various conditions, such as activity of the gold and sulfur sensitizer, type and size of silver halide tabular grains, temperature, pH and time of chemical ripening. These amounts, however, are preferably from 1 to 20 mg of gold sensitizer per mol of silver, and from 1 to 100 mg of sulfur sensitizer per mol of silver. The temperature of chemical ripening is preferably 45° C. or more, and more preferably from 50° C. to 80° C. The pAg and pH may take arbitrary values.

During chemical sensitization, addition times and order of gold sensitizer and sulfur sensitizer are not particularly limited. For example, gold and sulfur sensitizers can be added at the initial stage of chemical sensitization or at a later stage either simultaneously or at different times. Usually, gold and sulfur sensitizers are added to the silver halide tabular grain emulsion by their solutions in water, in a water-miscible organic solvent, such as methanol, ethanol and acetone, or in a mixture thereof.

Spectral Sensitization

The silver halide tabular grain emulsions are preferably spectrally sensitized. The silver halide tabular grain emulsion of the present invention is preferably spectrally sensitized with spectral sensitizing dyes having absorption maxima in the blue, minus blue (i.e., green and red) and infrared portions of the electromagnetic spectrum. Spectral sensitizing dyes for use in the present invention include polymethine dyes, such as cyanines and complex cyanines, merocyanines and complex merocyanines, as well as other dyes, such as oxonols, hemioxonols, styryls, merostyryls and streptocyanines as described by F. M. Hamer, The Cyanine and Related Compounds, Interscience Publishers, 1964.

The cyanine dyes include, joined by a methine linkage, two heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituents groups.

The merocyanine dyes include, joined by a methine linkage, a heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin-4-one.

The methine spectral sensitizing dyes for use in this invention are generally known in the art. Particular reference can be made to U.S. Pat. Nos. 2,503,776, 2,912,329, 3,148,187, 3,397,060, 3,573,916 and 3,822,136 and FR Pat. No. 1,118,778. Optimum or near optimum concentrations of spectral sensitizing dyes in the emulsions of the present invention generally range from 10 to 500 mg per mol of silver, preferably from 50 to 200, more preferably from 50 to 100.

Spectral sensitizing dyes can be used in combination which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, Photographic Science and Engineering, 18, pp. 418–430, 1974 and in U.S. Pat. Nos. 2,933,390, 3,635,721, 3,743,510, 3,615,613, 3,615,641, 3,617,295 and 3,635,721.

Spectral sensitization can be performed at any stage of silver halide tabular grains preparation. It can be performed subsequent to the completion of chemical sensitization or concurrently with chemical sensitization, or can precede chemical sensitization, or even can commence prior to the completion of silver halide precipitation. In the preferred form, spectral sensitizing dyes are incorporated in the silver halide tabular grain emulsions prior to chemical sensitization.

Photographic Material

The silver halide tabular grain emulsions are useful in light-sensitive photographic materials. A silver halide light-sensitive photographic material can be prepared by coating the above described silver halide emulsion on a photographic support. There is no limitation with respect to the support. Examples of materials suitable for the preparation of the support include glass, paper, polyethylene-coated paper, metals, cellulose nitrate, cellulose acetate, polystyrene, polyesters such as polyethylene terephthalate and polyethylene naphthalenate, polyethylene, polypropylene and other well-known supports.

Said silver halide light-sensitive photographic material can be a photographic color material such as a color negative film, a color reversal film, a color photographic printing paper, etc., as well as a black-and-white photographic material such as a radiographic element, a lithographic film, a black-and-white photographic printing paper, a black-and-white negative film, etc.

Preferred silver halide light-sensitive photographic materials are X-ray materials comprising the above described silver halide emulsion coated on one surface, preferably on both surfaces, of a support, preferably a polyethylene terephthalate support. Preferably, the silver halide emulsion is coated on the support at a total silver coverage comprised in the range of 3 to 6 grams per square meter. Usually, the X-ray light-sensitive materials are associated with intensifying screens so as to be exposed to radiation emitted by said screens. The screens are made of relatively thick phosphor layers which transform the X-rays into light radiation (e.g., visible light). The screens absorb a portion of X-rays much larger than the light-sensitive material and are used to reduce the X-ray dose necessary to obtain a useful image. According to their chemical composition, the phosphors can emit radiation in the blue, green or red region of the visible spectrum and the silver halide emulsions are sensitized to the wavelength region of the light emitted by the screens. Sensitization is performed by using spectral sensitizing dyes adsorbed on the surface of the silver halide grains as known in the art.

The exposed light-sensitive materials can be processed by any of the conventional processing techniques. The processing can be a black-and-white photographic processing for forming a silver image or a color photographic processing for forming a colored image. Such processing techniques are illustrated for example in Research Disclosure, 17643, December 1978. Roller transport processing in an automatic processor is particularly preferred, as illustrated in U.S. Pat. Nos. 3,025,779, 3,515,556, 3,545,971 and 3,647,459 and in UK Pat. No. 1,269,268. Hardening development can be undertaken, as illustrated in U.S. Pat. No. 3,232,761.

The emulsion layer containing the silver halide tabular grains can contain other constituents generally used in photographic products, such as binders, hardeners, surfactants, speed-increasing agents, stabilizers, plasticizers, optical sensitizers, dyes, ultraviolet absorbers, etc. References to such constituents can be found, for example, in Research Disclosure, Vol. 176 (December 1978), pp. 22–28.

The present invention is now illustrated by reference to the following non-limiting examples, which are not intended to limit the scope of the invention.

EXAMPLE

A set of four silver halide tabular grain emulsions A to D of the present invention and set of five comparative silver halide tabular grain emulsions E to I were prepared by using the method described above by varying the halide composition, the making temperatures, the gelatin concentration, the concentration of the silver nitrate solution and its rate of addition, the ammonia solution concentration, the ripening pBr, and other making conditions according to the following Table 1.

TABLE 1

| | A | B | C | D | E | F | G | H | I |
|---|---|---|---|---|---|---|---|---|---|
| Br/I Molar Ratio | 100/0 | 99/1 | 100/0 | 100/0 | 99/1 | 99/1 | 99/1 | 100/0 | 100/0 |
| Additional Solvent | / | / | / | / | NaSCN | NaSCN | / | / | / |
| Starting pH | 5.5 | 5.5 | 5.5 | 5.5 | 5.5 | 5.5 | 5.5 | 5.5 | 5.5 |
| Starting T° C. | 55 | 55 | 55 | 55 | 56 | 56 | 56 | 55 | 55 |
| Final T° C. | 70 | 70 | 70 | 70 | 56 | 56 | 56 | 70 | 70 |
| Starting pBr | 1.10 | 1.10 | 1.10 | 1.10 | 1.08 | 1.08 | 1.08 | 1.30 | 1.10 |
| Final pBr | 1.40 | 1.40 | 1.40 | 1.40 | 1.30 | 1.30 | 1.30 | 1.50 | 1.20 |
| Starting % gel | 0.58 | 0.58 | 0.58 | 0.58 | 1.42 | 1.42 | 1.42 | 0.58 | 0.58 |
| Split addition of gelatine (*) | Y | Y | Y | Y | N | N | N | Y | Y |
| Final % gel | 0.60 | 0.60 | 0.60 | 0.60 | 0.53 | 0.53 | 0.53 | 0.60 | 0.60 |
| $AgNO_3$ solution concentration | 2.5M | 2.5M | 1.3M | 1.3M | 2.5M | 2.5M | 2.5M | 1.3M | 2.5M |
| Ag addition ramp (finish/start) in nucleation and final steps | 1.0x | 1.0x | 1.0x | 1.0x | 1.0x | 1.0x | 1.0x | 1.0x | 1.0x |
| Ag addition ramp (finish/start) in growth step | 3.2x | 3.2x | 3.2x | 3.2x | 1.8x ÷ 1.3x | 4.2x ÷ 1.3x | 4.2x ÷ 1.3x | 3.2x | 3.2x |
| Ammonia ripening (Y/N) | Y | Y | Y | Y | N | Y | Y | Y | Y |
| % Ag mols in ripening | 4.5 | 4.5 | 4.5 | 3.5 | / | 72.0 | 72.0 | 3.0 | 4.5 |
| Ammonia concentration during ripening | 0.026M | 0.026M | 0.026M | 0.026M | / | 0.100M | 0.100M | 0.026M | 0.026M |
| T in ripening ° C. | 70 | 70 | 70 | 70 | / | 56 | 56 | 70 | 70 |
| Ripening time (minutes) | 10 | 10 | 10 | 10 | / | 10 | 10 | 10 | 10 |
| pBr in ripening | 1.30 | 1.30 | 1.30 | 1.15 | / | 1.30 | 1.30 | 1.00 | 1.30 |
| total Ag moles in 10 l vessel | 7.3 | 7.3 | 6.1 | 6.1 | 6.5 | 6.5 | 6.5 | 6.1 | 7.3 |
| initial water volume in 10 l vessel (ml) | 2733 | 2733 | 2296 | 2296 | 2722 | 2722 | 2694 | 2296 | 2733 |
| Nucleation step Ag flow rate ml/min part A | 19.5 | 19.5 | 32.0 | 32.0 | 15.4 | 15.4 | 10.2 | 32.0 | 19.5 |
| Nucleation step Ag flow rate ml/min part B | 6.0 | 6.0 | 9.8 | 9.8 | / | / | / | 9.8 | 6.0 |
| Growth step Ag flow rate ml/min, part A | 19.9 to 64.5 | 19.9 to 64.5 | 32.7 to 105.8 | 32.7 to 105.8 | 12.4 to 22.3 | 12.4 to 52.5 | 12.4 to 52.5 | 32.7 to 105.8 | 19.9 to 64.5 |
| Growth step Ag flow rate ml/min, part B | / | / | / | / | 52.0 to 70.0 | 52.0 to 70.0 | 52.0 to 70.0 | / | / |
| Final step Ag flow rate ml/min | 40.0 | 40.0 | 65.6 | 65.6 | 18.2 | 18.2 | 18.2 | 65.6 | 40.0 |

(*) A, B, C, D, H, I: the initial amount of gelatin was 32% of the total amount, E, F, G: the initial amount of gelatin was 100% of the total amount At the end of the silver halide tabular grain formation, water soluble salts were removed from the emulsion by procedures known in the art.

The emulsions were chemically and spectrally sensitized using conventional sulfur, gold, and palladium sensitizers plus a triethyl ammonium salt of 5,5'-dichloro-9-ethyl-3,3'-di-(3-sulfopropyl) oxacarbocyanine as spectral sensitization dye. The digest was performed for about 120 to 150 minutes at 60° C. The emulsions were successively stabilized with 200 mg of potassium iodide and 1366 mg of 5-methyl-7-hydroxy-2-3-4-triazoindolizine (4-hydroxy-6-methyl-1,3,3a,7-tetraazaindene) before chilling and kept in cold storage until needed for coating.

The resulting tabular grain emulsions A to I showed the characteristics exposed in the following Table 2.

TABLE 2

| | A | B | C | D | E | F | G | H | I |
|---|---|---|---|---|---|---|---|---|---|
| Average Diameter (μm) | 1.60 | 1.60 | 1.60 | 1.90 | 1.60 | 1.60 | 1.90 | 1.60 | 1.80 |
| Average Thickness (μm) | 0.112 | 0.115 | 0.103 | 0.111 | 0.087 | 0.102 | 0.111 | 0.112 | 0.112 |
| Average Aspect Ratio | 14.3 | 13.9 | 15.5 | 17.1 | 18.4 | 15.7 | 17.1 | 14.3 | 16.1 |
| COVd (%) | 37 | 37 | 40 | 37 | 38 | 38 | 37 | 30 | 45 |
| COVt (%) | 21 | 22 | 21 | 18 | 36 | 37 | 37 | 21 | 22 |
| Iodide content (%) | — | 1.0 | — | — | 1.0 | 1.0 | 1.0 | — | — |

The resulting silver halide emulsions A to I were immediately coated on two faces of blue 7 mil polyester support at a coating weight of 2.25 $gAg/m^2$ per face. An antistatic protective layer as described in EP 633,496 was coated on both emulsion layers, so obtaining radiographic film samples 1 to 9. The fresh film samples were kept 3 days at 38° C. before being subjected to X-ray exposure by using a Comet X-ray exaphase tungsten tube at 75 KVp for 0.06 sec with two LifeRay™ Regular type screens (manufactured by Ferrania S.p.A., Italy). The film samples were then processed with LIFERAY™ standard processing chemistry (LIFERAY™ XAD-3 developer and XAF-3 fixer, manufactured by Ferrania S.p.A., Italy) in a XP-515 automatic processing apparatus at 34° C. Development and fixing times were 25 and 27 seconds, respectively. The sensitometric results are reported in the following Table 3.

TABLE 3

| | Dmin | Toe Speed | Speed | Toe Contrast | Covering Power (*) |
|---|---|---|---|---|---|
| 1 (Invention) | 0.20 | 2.90 | 2.55 | 2.22 | 100 |
| 2 (Invention) | 0.20 | 2.90 | 2.55 | 2.22 | 100 |
| 3 (Invention) | 0.20 | 2.90 | 2.53 | 2.16 | 110 |
| 4 (Invention) | 0.21 | 3.00 | 2.63 | 2.21 | 100 |
| 5 (Comparison) | 0.21 | 2.90 | 2.52 | 2.00 | 120 |
| 6 (Comparison) | 0.21 | 2.90 | 2.55 | 2.22 | 110 |
| 7 (Comparison) | 0.22 | 3.00 | 2.60 | 1.90 | 100 |
| 8 (Comparison) | 0.20 | 2.87 | 2.55 | 2.35 | 100 |
| 9 (Comparison) | 0.21 | 3.00 | 2.65 | 2.05 | 100 |

(*) Sample 1 normalized to 100

The data of Table 3 clearly shows the improvement of the emulsion of the present invention in obtaining a better speed and toe contrast as well as lower Dmin, without negatively affecting the values of covering power. More in particular, the comparison of film sample 1 of the present invention with comparison film sample 8 clearly shows that a COVd lower than 31% negatively affect the toe contrast by providing a value too high and a consequent loss of detail in the zone at high density. The comparison of film samples 3 and 4 of the present invention with comparison film samples 6 and 7, respectively, clearly shows that the reduction of COVt allows to obtain a lower Dmin by maintaining the same values of speed and covering power. The comparison of film sample 4 of the present invention with comparison film sample 9 clearly shows that a COVd higher than 44% negatively affect the toe contrast by providing a value too low and a consequent loss of image sharpness.

Although specific examples of materials and conditions have been provided, they are intended to be exemplary and are not to be used to limit the generic scope of the invention. Those skilled in the art are capable of providing alternatives, equivalents and additions while still within the practice of the invention. Where bullets or numbering have been used to differentiate materials or steps in a process, those editorial conveniences are not intended to specifically limit the list to an order in time or importance. For example, in a process with steps a), b) and c), the process steps may be practiced in any rational order and the sequence is limited only by reasoned consideration. For example, if a process recites a) dissolving A, b) dissolving B, c) mixing solutions of A and B, and d) reacting the solutions of A and B. Steps a) and b) may be practiced in any order, step c) may be combined with step b), but step d) must be the last step practiced.

What is claimed is:

1. A silver halide tabular grain emulsion, wherein said silver halide emulsion comprises tabular grains having an average thickness lower than 0.15 μm, an average diameter of at least 1.20 μm and an average aspect ratio of at least 8:1, and showing a coefficient of diameter variation COVd within the range of from 31% to 44% and a coefficient of thickness variation COVt lower than 25%.

2. The silver halide tabular grain emulsion according to claim 1, wherein said tabular grains have an average thickness within the range of from 0.05 to 0.15 μm.

3. The silver halide tabular grain emulsion according to claim 1, wherein said tabular grains have an average diameter of at least 1.40 μm.

4. The silver halide tabular grain emulsion according to claim 1, wherein said tabular grains have an average aspect ratio of from 8:1 to 50:1.

5. The silver halide tabular grain emulsion according to claim 1, wherein said tabular grains have a coefficient of diameter variation COVd within the range of from 34 to 41%.

6. A silver halide radiographic element comprising a support and at least one silver halide emulsion layer coated on at least one side thereof, wherein said silver halide emulsion layer comprises a silver halide emulsion comprising tabular grains having an average thickness lower than 0.15 μm, an average diameter of at least 1.20 μm and an average aspect ratio of at least 8:1, and showing a coefficient of diameter variation COVd within the range of from 31% to 44% and a coefficient of thickness variation COVt lower than 25%.

7. The radiographic element according to claim 6, wherein said tabular grains have an average thickness within the range of from 0.05 μm to 0.15 μm.

8. The radiographic element according to claim 6, wherein said tabular grains have an average diameter of at least 1.40 μm.

9. The radiographic element according to claim 6, wherein said tabular grains have an average aspect ratio of from 8:1 to 50:1.

10. The radiographic element according to claim 6, wherein said tabular grains have a coefficient of diameter variation COVd within the range of from 34 to 41%.

* * * * *